US005341585A

United States Patent [19]

Stephan et al.

[11] Patent Number: 5,341,585

[45] Date of Patent: Aug. 30, 1994

[54] STEAM IRON WITH PUMP AND PRESSURE RESERVOIR

[75] Inventors: Hilmar Stephan, Gelnhausen; Gerhard Molz, Frankfurt am Main; Heinz Büttgen, Niedernberg, all of Fed. Rep. of Germany

[73] Assignee: Rowenta-Werke GmbH, Offenbach am Main, Fed. Rep. of Germany

[21] Appl. No.: 58,604

[22] Filed: May 6, 1993

[30] Foreign Application Priority Data

May 8, 1992 [DE] Fed. Rep. of Germany ..... 4214564

[51] Int. Cl.[5] ..... D06F 75/14

[52] U.S. Cl. ..... 38/77.5; 38/77.81

[58] Field of Search ..... 38/74, 77.1, 77.7, 77.81, 38/77.5, 77.82, 77.83

[56] References Cited

U.S. PATENT DOCUMENTS

| | | | |
|---|---|---|---|
| 1,697,224 | 1/1929 | Butman | 38/77.81 |
| 2,295,341 | 9/1942 | Finlayson | 38/77.81 |
| 2,750,692 | 6/1956 | Finlayson | 38/77.81 |
| 4,866,859 | 9/1989 | Kopelman | 38/77.81 X |

FOREIGN PATENT DOCUMENTS

| | | | |
|---|---|---|---|
| 0117852 | 9/1984 | European Pat. Off. | 38/77.5 |
| 0075097 | 4/1984 | Japan | 38/77.5 |
| 0118200 | 7/1984 | Japan | 38/77.5 |
| 0161000 | 8/1985 | Japan | 38/77.5 |

*Primary Examiner*—Clifford D. Crowder
*Assistant Examiner*—Ismael Izaguirre
*Attorney, Agent, or Firm*—Anderson Kill Olick & Oshinsky

[57] ABSTRACT

The invention relates to a steam iron comprising a water tank 1 and an evaporation chamber 13, the water supply from the water tank to the evaporation chamber being effected via an electric pump 2, whose operation is dependent upon the water level in a reservoir 3 provided in the water supply between the pump and the evaporation chamber.

7 Claims, 1 Drawing Sheet

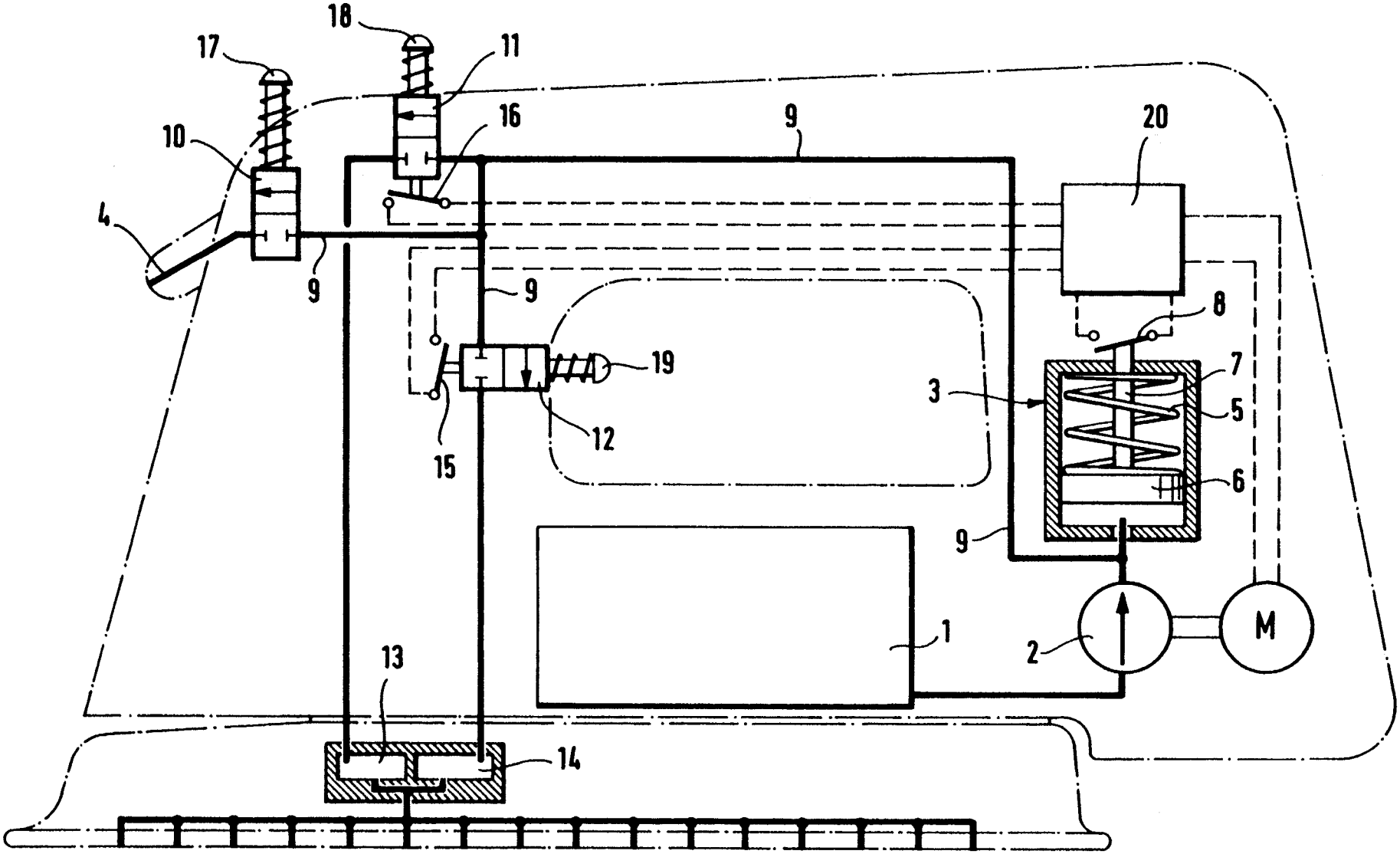
M
20
8
7
5
6
2
3
9
1
9
19
12
14
11
16
9
15
13
18
9
17
10
4

STEAM IRON WITH PUMP AND PRESSURE RESERVOIR

FIELD OF THE INVENTION

The invention relates to a steam iron with a water tank, a controllable electric pump connected to the water tank as well as an evaporation chamber fed by valve-controllable supply lines, the water being delivered from the water tank to the evaporation chamber via the pump.

BACKGROUND OF THE INVENTION

In most electric steam irons of this kind the water supply from the water tank to the evaporation chamber is carried out via a dripfeed valve, which enables the water to flow in a controlled manner into the evaporation chamber. Piston pumps, which may be actuated by buttons projecting from the iron handle DE-OS 24 42 126), are provided for producing a steam jet and for spraying water. The disadvantage in these irons, however, is that the dripfeed valves are very susceptible to calcination which leads to a narrowing of the extremely small water port. The actuation of the piston pumps requires, moreover, additional strength which a woman's hand cannot be expected to have. In order to overcome this disadvantage, it is known in steam irons that the water may be supplied from the water tank into the evaporation chamber via an electrically controlled pump (DE-AS 11 60 399). Steam irons equipped with electrically controlled pumps and provided with an additional spray device are also known (DE-GM 90 00 917). In these irons, the pump is connected to the evaporation chamber and the spray device via a pipe system and valves.

These known steam irons have the disadvantage that after the switching-on of the pump, it takes a certain time for the user to have enough water with the required water pressure and for the actuated pump to operate continuously, so that it is not possible to feed a quantitively regulated amount of water into the evaporation chamber which is required for producing a steam jet.

SUMMARY OF THE INVENTION

The invention has the object of providing a steam iron of this kind, in which, when the pump is switched on, the user has immediately sufficient water with the necessary water pressure, and it is possible, when required, to supply an accurately measured amount of water to the evaporation chamber for producing a vapour jet.

On the basis of the invention, it is achieved that in the operating condition, there is always a constant pressure in the entire pipe system as a result of the pressure reservoir, that the operation of the pump is interrupted by the pump switch as soon as the pressure reservoir has reached its maximum level, and that the pump only restarts its operation when the amount of water in the pressure reservoir falls below a predetermined level. In this way the user is immediately supplied with sufficient water at the required pressure, since, when the steam iron is switched on, the entire system has the necessary operating pressure so that operation may be started immediately without any delay via the appropriate valves and an accurately measured amount of water may be supplied to the evaporation chamber.

An embodiment of the invention is schematically shown in the drawing and hereinafter described in more detail.

BRIEF DESCRIPTION OF THE DRAWING

FIG. 1 illustrates a steam iron which is the subject of the present invention.

DETAILED DESCRIPTION OF THE PREFERRED EMBODIMENT

The steam iron schematically shown in FIG. 1 has a water tank 1, an electric pump 2, a pressure reservoir 3 and a spray device 4. The cylindrical pressure reservoir 3 is in the form of a pressure-loaded water reservoir. A piston 6 displaceable by the pressure of a spring 5 is arranged inside the pressure reservoir 3, the piston rod 7 of the piston 6 being in operative connection with an electric switch. The pump 2 and the pressure reservoir 3 are connected, via supply lines 9 and cutoff valves 10, 11 and 12, to the evaporation chamber 13, the auxiliary steam chamber 14 and the spray device 4. The actuation of the cutoff valves, 10, 11, and 12 is effected manually via manual actuation members 17, 18, and 19, the valves 11 and 12 being electrically coupled to an electronic pulse circuit 20 via electric switches 15 and 16. Upon reaching the maximum capacity of the pressure reservoir 3, the switch 8 is actuated by the piston rod 7 and the pump 2 is switched off. If the water level in the pressure reservoir 3 falls below a certain level, the pump 2 is switched on again via the switch 8. Pump 2 and pressure reservoir 3 thus form a control circuit which ensures that there is always sufficient water at the outlet of the supply line 9 and that the water always has the required water pressure since the water withdrawn from the pressure reservoir 3 is immediately replaced. The optimum operating pressure for the entire water storage system is adjustable in the pressure reservoir 3. The pressure reservoir 3 shown in FIG. 1 is only one possible exemplary embodiment of the subject of the invention.

When the iron is in the operating condition, it is switched on, whereupon the pump supplying water from the water tank 1 to the pressure reservoir 3 is started simultaneously so that the required amount of water at the necessary operating pressure, supplied at the outlet of the supply lines 9, is immediately available to the user. This pressure is the same in the entire system and the relevant control command by the respective user is responded to immediately, without any delay.

In order to produce normal steam, the cutoff valve the outlet of the supply line 9 and that the water always has the required water pressure since the water withdrawn from the pressure reservoir 3 is immediately replaced. The optimum operating pressure for the entire water storage system is adjustable in the pressure reservoir 3. The pressure reservoir 3 shown in FIG. 1 is only one possible exemplary embodiment of the subject of the invention.

When the iron is in the operating condition, it is switched on, whereupon the pump supplying water from the water tank 1 to the pressure reservoir 3 is started simultaneously so that the required amount of water at the necessary operating pressure, supplied at the outlet of the supply lines 9, is immediately available to the user. This pressure is the same in the entire system and the relevant control command by the respective user is responded to immediately, without any delay.

In order to produce normal steam, the cutoff valve 11 is actuated by the manual actuation member 18 and the electric switch 16 is simultaneously closed, the electronic pulse circuit 20 thus bridging the switch 8 and driving pump 2 so that a measured amount of water is supplied from the water tank 1 to the evaporation chamber 13. When normal steam is produced, the pressure reservoir 3 is not in operation and the water supply to the evaporation chamber 13 is effected via the pump 2. However, since water at the required operating pressure is already available at the outlet of the supply lines 9, before the valves 10, 11 and 12 are operated, the content of the pressure reservoir 3 is immediately emptied into the evaporation chamber 13 upon actuation of the cutoff valve 11, thus bridging the reaction delay of the pump 2.

In order to produce additional steam, the cutoff valve 12 is actuated for a short period via the manual actuation member 19 as a result of which the valve is opened and the electric switch 15 is simultaneously closed. The electric circuit to the pump 2 is thus disconnected via the electronic pulse circuit 20 and the contents of the pressure reservoir 3 are fed to the auxiliary steam chamber 14, thus producing a burst of steam. If the actuation of the cutoff valve 12 is interrupted, the pump 2 restarts its operation and fills the pressure reservoir 3. A burst of steam may be produced several times in succession, if it should be necessary.

In order to spray the items to be ironed beforehand in the region surrounding the iron, the cutoff valve 10 is opened via the manual actuation member 17 and water from the water tank 1 is sprayed onto the items, by means of the pump 2 and the spray device 4. The spraying is carried out until the cutoff valve 10 is activated.

The cutoff valves used may also be solenoid-operated valves which may be actuated via sensors and a suitable electronic circuit.

REFERENCE NUMERALS

1=Water tank
2=Pump
3=Pressure reservoir
4=Spray device
5=Spring
6=Piston
7=Piston rod
8=Pressure switch
9=Supply lines
10=First valve
11=Second valve
12=Third valve
13=Evaporation chamber
14=Auxiliary steam chamber
15=First electric switch
16=Second electric switch
17=Manual actuation member
18=Manual actuation member
19=Manual actuation member
20=Electronic pulse circuit

We claim:

1. A steam iron which comprises:
an evaporation chamber;
a pump for supplying water from a water tank to said evaporation chamber; and
a pressure reservoir which is provided between said pump and said evaporation chamber, wherein the operation of said pump is controllable between on and off modes as a function of an amount of water in said pressure reservoir.

2. A steam iron which comprises:
a water tank;
a controllable electric pump which is connected to said water tank, and an evaporation chamber which is supplied with water via valve-controllable supply lines, wherein the water supply from said water tank to said evaporation chamber is effected by said pump, and wherein at least one pressure reservoir is disposed between said pump and said evaporation chamber, and further wherein an electric switch is in operative connection with said pressure reservoir, wherein said electric switch switches said pump on or off as a function of the level of filling of said pressure reservoir with water.

3. The steam iron of claim 2, wherein the quantitative measuring of an amount of steam is effected by driving said pump via an electronic pulse circuit.

4. The steam iron of claim 2, further comprising;
a spray device which is activated by a manual actuation member and which is controlled via a first cutoff valve.

5. The steam iron of claim 4, wherein the quantitative measuring of an amount of steam is effected by driving said pump via an electronic pulse circuit.

6. The steam iron of claim 4, wherein said water tank, said pump and said pressure reservoir are connected to at least one of said evaporation chamber, an auxiliary steam chamber and said spray device via a system of supply lines.

7. The steam iron of claim 6, wherein the quantitative measuring of an amount of steam is effected by driving said pump via an electronic pulse circuit.

* * * * *